US009229405B2

(12) United States Patent
Itagaki

(10) Patent No.: US 9,229,405 B2
(45) Date of Patent: Jan. 5, 2016

(54) IMAGE FORMING APPARATUS

(71) Applicant: CANON KABUSHIKI KAISHA, Tokyo (JP)

(72) Inventor: Tomohisa Itagaki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/196,601

(22) Filed: Mar. 4, 2014

(65) Prior Publication Data

US 2014/0255051 A1 Sep. 11, 2014

(30) Foreign Application Priority Data

Mar. 5, 2013 (JP) ..... 2013-043229

(51) Int. Cl.
*G03G 15/00* (2006.01)

(52) U.S. Cl.
CPC ..... *G03G 15/5062* (2013.01)

(58) Field of Classification Search
USPC ..... 399/49
See application file for complete search history.

(56) References Cited

U.S. PATENT DOCUMENTS

| | | | | |
|---|---|---|---|---|
| 7,154,619 | B1 * | 12/2006 | Yoshida et al. | 358/1.14 |
| 2005/0073696 | A1 * | 4/2005 | Mackenzie et al. | 358/1.6 |
| 2006/0165425 | A1 * | 7/2006 | Matayoshi et al. | 399/49 |

FOREIGN PATENT DOCUMENTS

| | | | |
|---|---|---|---|
| JP | 2004-163216 | A | 6/2004 |
| JP | 2006-058565 | A | 3/2006 |
| JP | 2006058565 | A * | 3/2006 |

* cited by examiner

*Primary Examiner* — Clayton E Laballe
*Assistant Examiner* — Linda B Smith
(74) *Attorney, Agent, or Firm* — Canon U.S.A., Inc. IP Division

(57) ABSTRACT

An image forming apparatus includes a feeding unit configured to feed a sheet, an image forming unit configured to form a measurement image on the sheet fed by the feeding unit, a measuring unit configured to measure the measurement image formed on the sheet by the image forming unit, and an adjustment unit configured to perform an adjustment operation on basis of a measurement result of the measurement image. In this case, the image forming unit forms the measurement image of a first side of the sheet and forms a setting aid image on a second side that is different from the first side, and the setting aid image shows information describing the direction of the sheet for setting in the feeding unit and information for prompting to set the sheet with the second side up in the feeding unit.

16 Claims, 17 Drawing Sheets

FIG. 18

| FEEDER | LOCATION | MESSAGE TO BE PRINTED ON FIRST SIDE | MESSAGE TO BE PRINTED ON SECOND SIDE |
|---|---|---|---|
| A | IMAGE FORMING APPARATUS 100 | FACE THIS SIDE UP WITH ARROW TO THE RIGHT | FACE THIS SIDE DOWN WITH ARROW TO THE RIGHT |
| B | IMAGE FORMING APPARATUS 100 | | |
| C | DECK 500 | FACE THIS SIDE DOWN WITH ARROW TO THE LEFT | FACE THIS SIDE UP WITH ARROW TO THE LEFT |
| D | DECK 500 | | |
| E | DECK 500 | | |
| F | DECK 510 | | |
| G | DECK 510 | | |
| H | DECK 510 | | |
| I | DECK 520 | FACE THIS SIDE UP WITH ARROW TO THE RIGHT | FACE THIS SIDE DOWN WITH ARROW TO THE RIGHT |

IMAGE FORMING APPARATUS

BACKGROUND OF THE INVENTION

1. Field of the Invention

The present invention relates to an image forming apparatus capable of correcting unevenness of an image in a main scanning direction.

2. Description of the Related Art

An image forming apparatus may provide various image qualities such as graininess, uniformity in a plane, character quality, and reproducibility (including color stability). Such image qualities provided by an electrophotography image forming apparatus may be influenced by uneven electrification caused by degradation of a charger which electrostatically charges a photosensitive drum, uneven exposure of a laser scanner, for example, configured to form an electrostatic latent image on a photosensitive drum, uneven development by a developing device which develops an electrostatic latent image or the like.

These unevennesses may cause uneven density and/or uneven color in a main scanning direction (orthogonal to a sheet conveying direction for forming an image on a sheet), which may disadvantageously deteriorate uniformity in a plane.

Japanese Patent Laid-Open No. 2004-163216 proposes a technology (main-scanning shading correction) of outputting a sheet on which a plurality of test patterns are printed in a main scanning direction and measuring color densities of the test patterns with a handy densitometer, for example, to correct an uneven density in the main scanning direction.

On the other hand, Japanese Patent Laid-Open No. 2006-58565 discloses a method of performing such main-scanning shading correction by using a color sensor internally mounted in an image forming apparatus.

Japanese Patent Laid-Open No. 2006-58565 discloses a technology of forming a band-shaped test pattern based on an equal image signal value in a main scanning direction of a sheet. Japanese Patent Laid-Open No. 2006-58565 further discloses a technology of rotating a sheet having a test pattern 90 degrees, setting it to a feeder, refeeding the sheet, and measuring the test pattern by using a color sensor within an image forming apparatus.

However, a user may be required to determine whether a sheet having a test pattern is to be set with its face up or down and/or by rotating 90 degrees to the right or to the left in accordance with the feeder in which the sheet is to be set.

This may require a user to set a sheet in consideration of the side and right or left direction of the sheet, which lowers user's operability. When such a sheet is set in a wrong direction in a feeder, a correct measurement result may not be acquired from the test pattern. In such a case, the user must set the sheet in the feeder again, which may cause user stress.

SUMMARY OF THE INVENTION

According to an aspect of the present invention, there is provided an image forming apparatus including a feeding unit configured to feed a sheet, an image forming unit configured to form a measurement image on the sheet fed by the feeding unit, a measuring unit configured to measure the measurement image formed on the sheet by the image forming unit, and an adjustment unit configured to perform an adjustment operation on basis of a measurement result of the measurement image. In this case, the image forming unit forms the measurement image of a first side of the sheet and forms a setting aid image on a second side that is different from the first side, and the setting aid image shows information describing the direction of the sheet for setting in the feeding unit and information for prompting to set the sheet with the second side up in the feeding unit.

An image forming apparatus according to the present invention may reduce user stress involved in main scanning shading.

Further features of the present invention will become apparent from the following description of exemplary embodiments with reference to the attached drawings.

BRIEF DESCRIPTION OF THE DRAWINGS

FIG. 18 is a table illustrating information to be shown on first and second sides of a chart for each feeder.

DESCRIPTION OF THE EMBODIMENTS

First Embodiment

Image Forming Apparatus

According to a first embodiment, an electrophotography laser beam printer is applied. For example, electrophotography is adopted as an image formation method. However, the present invention is applicable to an ink-jet method or a dye sublimation method.

Figure 1:
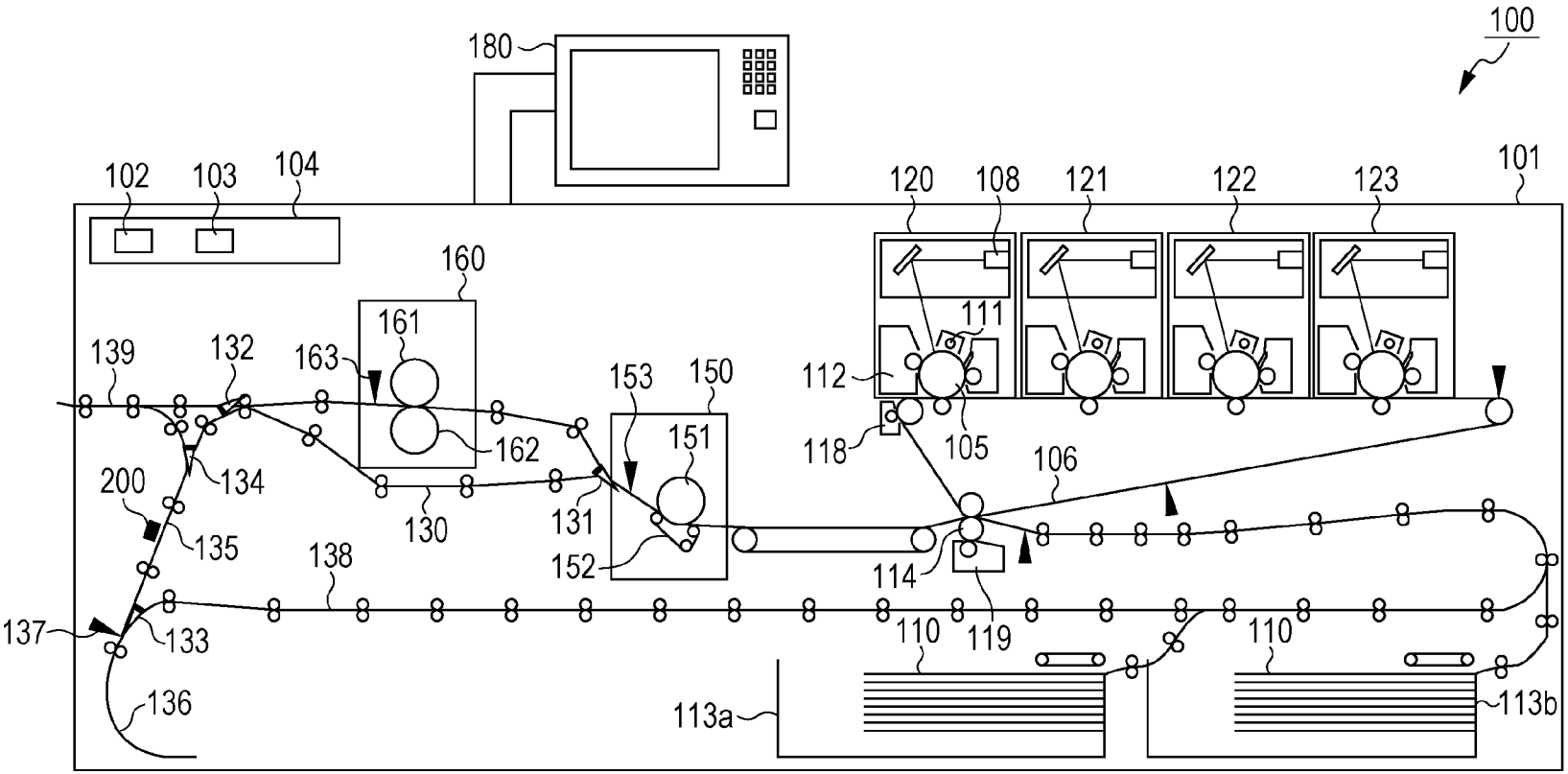
FIG. 1 is a section view illustrating a structure of an image forming apparatus.

FIG. 1 is a section view illustrating a structure of an image forming apparatus 100. The image forming apparatus 100 includes a housing 101. The housing 101 contains mechanisms that configure an engine unit and a control board container 104. The control board container 104 contains an engine control unit 102 configured to perform control relating to printing processes (such as a feeding process) by the mechanisms and a printer controller 103.

As illustrated in FIG. 1, the engine unit includes four YMCK stations 120, 121, 122, and 123. The station 120, 121, 122, and 123 are image forming units configured to transfer toners to a sheet 110 to form an image. Here, YMCK stands for yellow, magenta, cyan, and black. Each of the stations includes substantially common components. A photosensitive drum 105 is a type of image-bearing member. After the photosensitive drum 105 starts rotating, a charger 111 electrostatically charges the photosensitive drum 105 to uniform surface potentials. A laser 108 exposes the photosensitive drum 105 charged by the charger 111. In other words, a laser beam emitted from the laser 108 scans the photosensitive drum 105. Thus, the laser 108 forms an electrostatic latent image on the photosensitive drum 105. The amount of laser exposure for the tone of each pixel may be changed by pulse width modulation (PWM). It should be noted that the main scanning direction of the photosensitive drum 105 corresponds to the direction in which a laser beam scans the photosensitive drum 105.

A developing device 112 uses a coloring material (toner) to develop a latent image to form a toner image. The toner image (visible image) is transferred onto an intermediate transfer member 106. The visible image formed on the intermediate transfer member 106 is transferred by a transfer roller 114 to a sheet 110 conveyed from the container 113*a* and container 113*b*. The intermediate transfer member 106 and transfer roller 114 are abutted against cleaning mechanisms 118 and 119 capable of removing toner adhered to the intermediate transfer member 106 and transfer roller 114.

A fixing mechanism according to this embodiment includes a first fixing unit 150 and a second fixing unit 160 configured to heat and press a toner image transferred onto the sheet 110 to fix it to the sheet 110. The first fixing unit 150 includes a fixing roller 151 configured to heat a sheet 110, a pressing belt 152 configured to press a sheet 110 to the fixing roller 151, and a first post-fixing sensor 153 configured to detect a completion of fixing. The fixing roller 151 is a hollow roller and internally has a heater.

A second fixing unit 160 is disposed downstream of the first fixing unit 150 in the sheet conveying direction. The second fixing unit 160 may gloss and provides fixability to a toner image on a sheet which is fixed by the first fixing unit 150. Like the first fixing unit 150, the second fixing unit 160 includes a fixing roller 161, a pressing roller 162, and a second post-fixing sensor 163. Some types of sheet 110 do not require passage through the second fixing unit 160. In this case, a sheet 110 passes through a conveying path 130 without through the second fixing unit 160 for reduction of energy consumption.

For example, when high glossing on an image on a sheet 110 is set or when a large amount of heat is required for fixing on a sheet 110 like a case where the sheet 110 is thick paper, the sheet 110 having passed through the first fixing unit 150 is further conveyed to the second fixing unit 160. On the other hand, in a case where the sheet 110 is plain paper or thin paper but high glossing is not set, the sheet 110 is conveyed through a conveying path 130 that detours the second fixing unit 160. The switching member 131 is usable for controlling whether the sheet 110 is to be conveyed to the second fixing unit 160 or the sheet 110 is to be conveyed by detouring the second fixing unit 160.

An ejected-paper conveying path 139 is a conveying path for ejecting a sheet 110 externally. The switching member 132 is usable for controlling whether the sheet 110 is to be guided to the conveying path 135 or to the ejected-paper conveying path 139. A leading end of the sheet 110 guided to the conveying path 135 passes through a reverse sensor 137 and is conveyed to a reverse unit 136. If the reverse sensor 137 detects a trailing end of the sheet 110, the conveying direction of the sheet 110 is changed. The switching member 133 is usable for controlling whether the sheet 110 is to be guided to a conveying path 138 for double-sided image formation or to the conveying path 135.

A color sensor 200 configured to detect a patch image on a sheet 110 is disposed on the conveying path 135. The color sensor 200 includes four sensors 200*a* to 200*d* aligned in the direction orthogonal to the conveying direction of the sheet 110 and capable of detecting four patch image lines. If a measurement is instructed through an operating unit 180, the engine control unit 102 executes main-scanning shading correction, maximum density adjustment, tone adjustment, multinary color correction processes and/or the like. Notably, a density adjustment or tone adjustment process measures a color density of a monochromatic measurement image. A multinary color correction process measures color of a measurement image on which a plurality of colors are overlapped.

A switching member 134 is a guiding member configured to guide a sheet 110 to the ejected-paper conveying path 139. A sheet 110 conveyed through the ejected-paper conveying path 139 is ejected externally to the image forming apparatus 100.

Color Sensor

Figure 2:
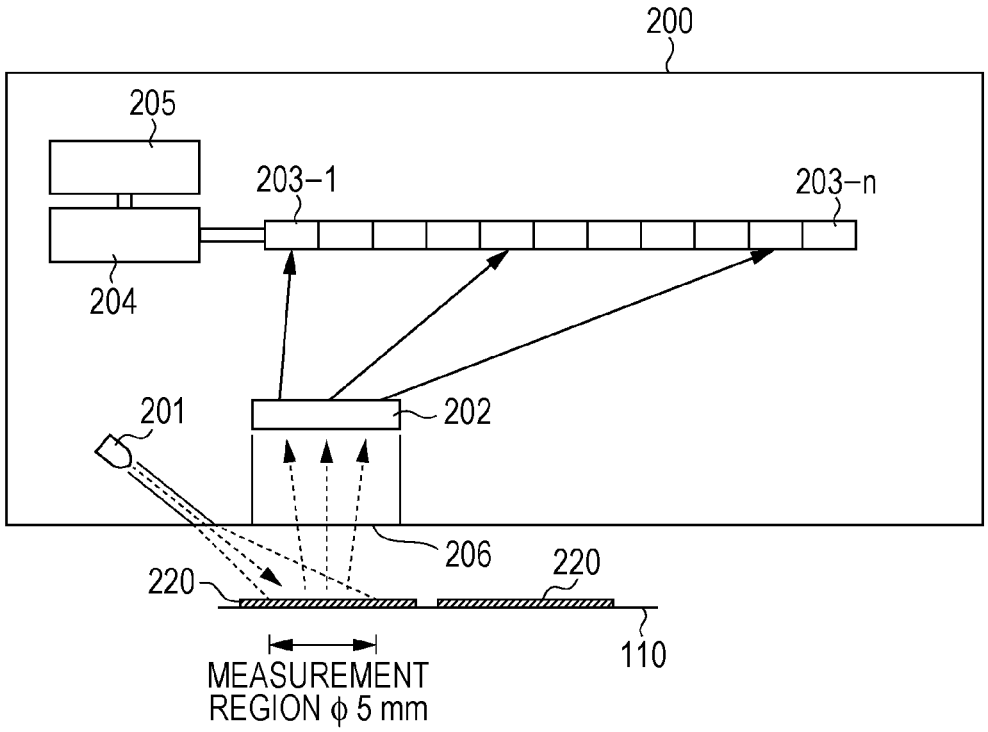
FIG. 2 illustrates a color sensor.

FIG. 2 illustrates a structure of the color sensor 200. The color sensor 200 internally contains a white LED 201, a diffraction grating 202, a line sensor 203, a computing unit 204, and a memory 205. The white LED 201 is a light emitting device configured to radiate light to a patch image 220 on a sheet 110. The light reflected from the patch image 220 passes through a window 206 configured by a transparent member.

The diffraction grating 202 disperses reflected light from the patch image 220 for each wavelength. The line sensor 203 is a photodetecting element including n light receiving elements configured to detect the light dispersed for each wavelength by the diffraction grating 202. The computing unit 204 computes on basis of light intensity values of pixels detected by the line sensor 203.

The memory 205 stores data to be used by the computing unit 204. The computing unit 204 may have a spectral computing unit configured to compute a spectral reflectivity from a light intensity value. A lens may further be provided which converges light radiated from the white LED 201 onto the patch image 220 on the sheet 110 or converges light reflected from the patch image 220 to the diffraction grating 202. A measurement region for measuring a patch image on a sheet 110 with the color sensor 200 is equal to an area irradiated by the white LED 201 (spot diameter) and is equal to $\phi 5$ mm according to this embodiment.

Figure 3:
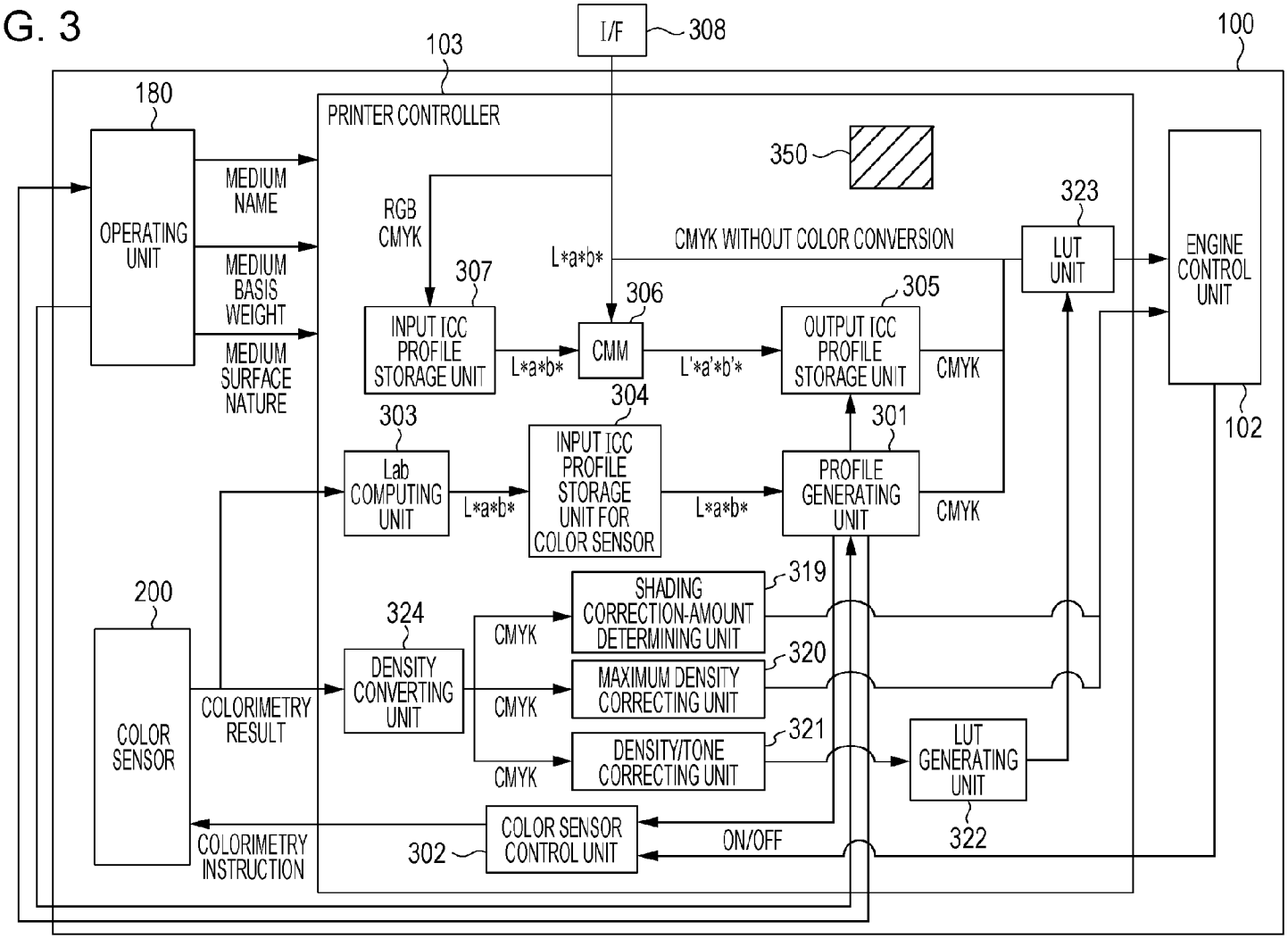
FIG. 3 is a block diagram illustrating a system configuration of an image forming apparatus.

FIG. 3 is a block diagram illustrating a system configuration of the image forming apparatus 100. With reference to FIG. 3, maximum density adjustment, tone adjustment, and multinary color correction processes will be described. For easy understanding of the processes to be performed by the printer controller 103, FIG. 3 illustrates internal components of the printer controller 103.

Maximum Density Adjustment

First, the printer controller 103 instructs the engine control unit 102 to output a test chart to be used for a maximum-density adjustment. In this case, CMYK patch images for maximum-density adjustment are formed on a sheet 110 with the charged potential, exposure intensity, and development bias that are preset or set in the last maximum-density adjustment. After that, the engine control unit 102 instructs the color sensor control unit 302 to measure the patch images.

After the color sensor 200 measures the patch images, the measured results are transmitted to a density conversion unit 324 as spectral reflectivity data. The density conversion unit 324 converts the spectral reflectivity data to CMYK color density data and transmits the converted color density data to the maximum-density correction unit 320.

The maximum-density correction unit 320 calculates correction amounts for the charged potential, exposure intensity, and development bias such that the color density output when image data having a maximum density is toner image may have a desirable value and transmits the calculated correction amounts to the engine control unit 102. The engine control unit 102 uses the correction amounts for the transmitted charged potential, exposure intensity, and development bias in subsequent image formation operations. The operation described above may adjust the maximum density of an image to be output.

Tone Adjustment

After a maximum-density adjustment process ends, the printer controller 103 instructs the engine control unit 102 to form patch images having 16 tones on a sheet 110. The image signals of the patch images having 16 tones may be referred by 00H, 10H, 20H, 30H, 40H, 50H, 60H, 70H, 80H, 90H, A0H, B0H, C0H, D0H, E0H, and FFH, for example.

In this case, the correction amounts for the charged potential, exposure intensity, and development bias calculated in the maximum-density adjustment are used for forming CMYK patch images for 16 tones on a sheet 110. After the patch images for 16 tones are formed on a sheet 110, the engine control unit 102 instructs the color sensor control unit 302 to measure the patch images.

After the color sensor 200 measures the patch images, the measurement results are transmitted to the density conversion unit 324 as spectral reflectivity data. The density conversion unit 324 converts the spectral reflectivity data to CMYK color density data and transmits the converted color density data to a color density/tone correction unit 321. The color density/tone correction unit 321 calculates a correction amount for the amount of exposure to acquire a desirable tonality. An LUT generating unit 322 generates a monochromatic tone LUT and transmits it to an LUT unit 323 as CMYK signal values.

Profile

In order to perform a multinary color adjustment process, the image forming apparatus 100 generates an ICC profile, which will be described below, from measurement results from patch images including multinary color and uses the profile to convert an input image and form an output image.

Figure 4:
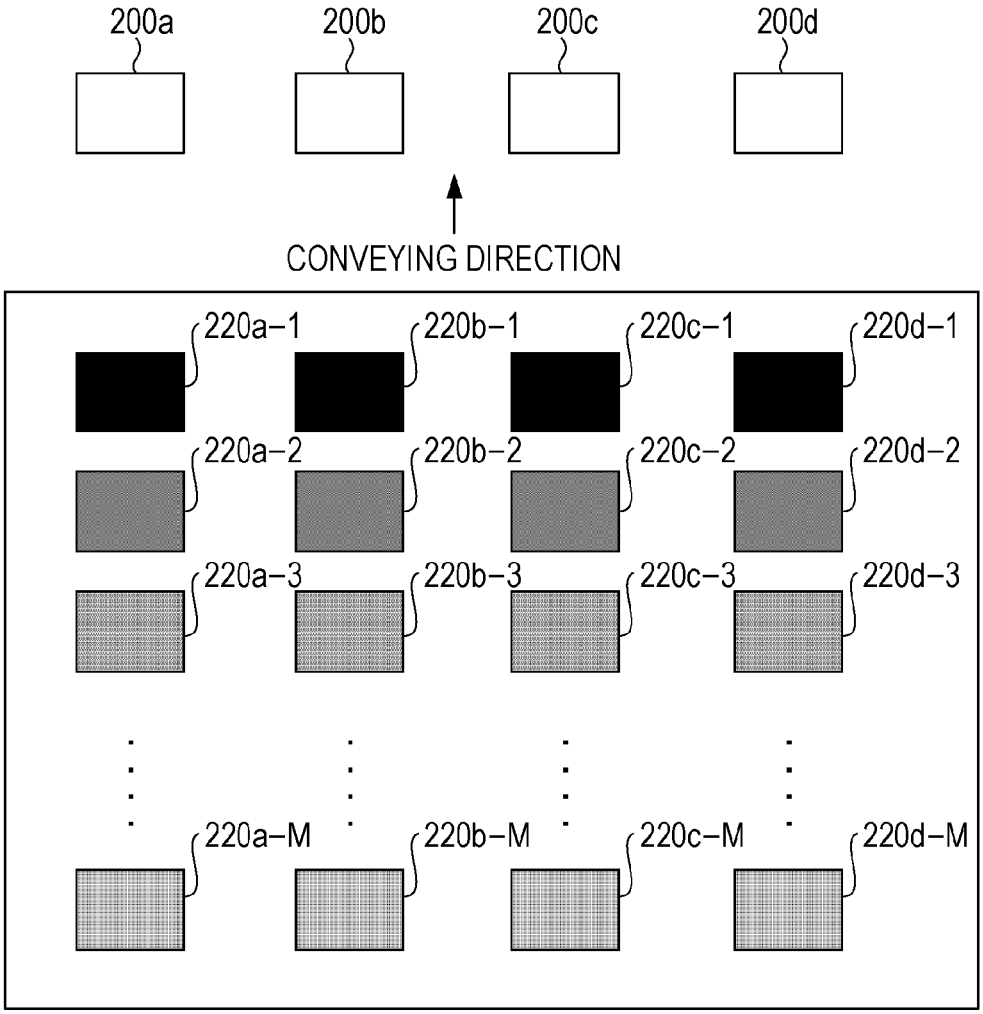
FIG. 4 is a conceptual diagram illustrating a color measurement chart.

The halftone area ratios of the patch image 220 including multinary color are changed to three levels (0%, 50%, 100%) for each of the four CMYK colors to form patch images having all combinations of the halftone area ratios. The patch images 220 are formed in four lines to be read by the color sensors 200*a* to 200*d* as illustrated in FIG. 4.

An ICC profile having been accepted by the market in recent years is used here as a profile that may provide high reproducibility. However, the present invention is applicable without an ICC profile. The present invention is applicable to Color Rendering Dictionary (CRD) adopted from Level 2 of PostScript proposed by Adobe, a color separation table within Photoshop (registered trademark) and so on.

For component replacement by a customer engineer, before a job requiring color matching accuracy or to identify the hue of a final output matter during a designing stage, a user may operate the operating unit 180 to instruct to generate a color profile.

The profile generation processing is performed by the printer controller 103 illustrated in the block diagram in FIG. 3. The printer controller 103 has a CPU configured to read and execute a program for executing processing on a flowchart, which will be described below, from the storage unit 350.

When the operating unit 180 receives the profile generation instruction, a profile generation unit 301 outputs a CMYK color chart 210 that is an ISO12642 test form to the engine control unit 102 without through a profile. The profile generation unit 301 transmits a measurement instruction to the color sensor control unit 302. The engine control unit 102 controls the image forming apparatus 100 to execute a charging, exposure, development, transfer, fixing processes or the like. Thus, the ISO12642 test form is formed on the sheet 110.

The color sensor control unit 302 controls the color sensor 200 to measure the ISO12642 test form. The color sensor 200 outputs spectral reflectivity data that is a measurement result to a Lab computing unit 303 in the printer controller 103. The Lab computing unit 303 converts the spectral reflectivity data to color value data (L*a*b* data) and outputs it to the profile generation unit 301. In this case, the L*a*b* data output from the Lab computing unit 303 is converted by using color-sensor input ICC profile stored in a color-sensor input ICC profile storage unit 304. The Lab computing unit 303 may convert spectral reflectivity data to a CIE1931XYZ color specification system that is a device-independent color space signal.

The profile generation unit 301 generates an output ICC profile from a relationship between a CMYK color signal output to the engine control unit 102 and L*a*b* data converted by using the color-sensor input ICC profile. The profile generation unit 301 stores the generated output ICC profile in an output-ICC-profile storage unit 305.

An ISO12642 test form includes a patch of a CMYK color signal that covers a color gamut that can be output by a general copier. Therefore, The profile generation unit 301 generates a color conversion table from a relationship between individual color signal values and measured L*a*b* values. In other words, a CMYK→Lab conversion table is generated. An inverse conversion table is generated on basis of the conversion table.

In response to a profile creation instruction from a host computer through an I/F 308, the profile generation unit 301 outputs the generated output ICC profile through the I/F 308. The host computer is capable of executing a color conversion corresponding to an ICC profile with an application program.

Color Conversion Process

In a color conversion to a normal color output, RGB signal values input from a scanner unit through the I/F 308 or an image signal input by assuming standard print CMYK signal values of JapanColor, for example, are transmitted to an input-ICC profile storage unit 307 for external input. The input-ICC profile storage unit 307 executes RGB→Lab or CMYK→Lab conversion in accordance with the image signal input from the I/F 308. An input ICC profile stored in the input-ICC profile storage unit 307 includes a plurality of look-up tables (LUTs).

Those LUTs may include a one-dimensional LUT for controlling gamma of an input signal, a multinary color LUT called a direct mapping, and a one-dimensional LUT for controlling gamma of generated conversion data. These tables are used to convert an input image signal from a device dependent color space to a device-independent L*a*b* data.

An image signal converted to L*a*b* coordinates is input to a color management module (CMM) 306. The CMM 306 executes a color conversion. For example, the CMM 306 may execute GAMUT conversion that maps a mismatch between a reading color space of an input apparatus such as a scanner unit, for example, and an output-color reproducible range of an output apparatus such as the image forming apparatus 100. The CMM 306 may further execute a color conversion that adjusts a mismatch between the type of a light source for inputting and the type of a light source for observing an output matter (which may be called a mismatch of color temperature settings).

Through this operation, the CMM 306 converts L*a*b* data to L'*a'*b'* data to the output-ICC-profile storage unit 305. A profile generated on basis of a measurement result is stored in the output-ICC-profile storage unit 305. Thus, the output-ICC-profile storage unit 305 executes color conversion of the L'*a'*b'* data with the newly generated ICC profile to a CMYK signal dependent on the output apparatus and outputs it to the engine control unit 102.

Figure 5:
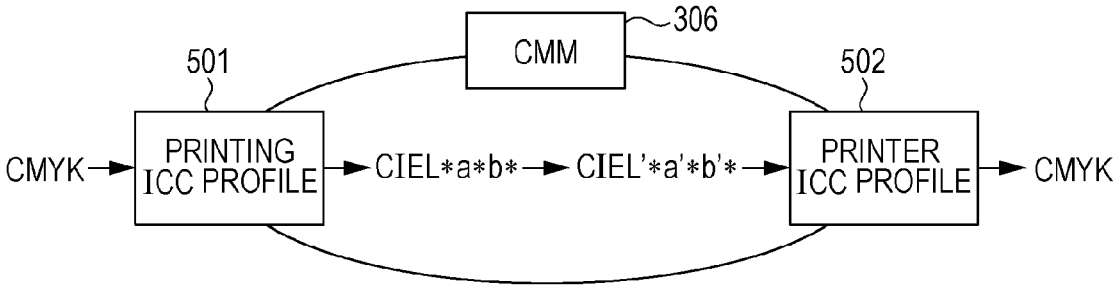
FIG. 5 is a schematic diagram of a color management environment.

Referring to FIG. 3, the CMM 306 is separated from the input-ICC profile storage unit 307 and the output-ICC-profile storage unit 305. However, as illustrated in FIG. 5, the CMM 306 is a module responsible for color management and thus performs color conversion by using an input profile (printing ICC profile 501) and an output profile (printer ICC profile 502).

A shading correction-amount determining unit 319 determines a correction amount in a main-scanning shading mode. The main-scanning shading mode will be described in detail below.

Operating Unit

Figure 6:
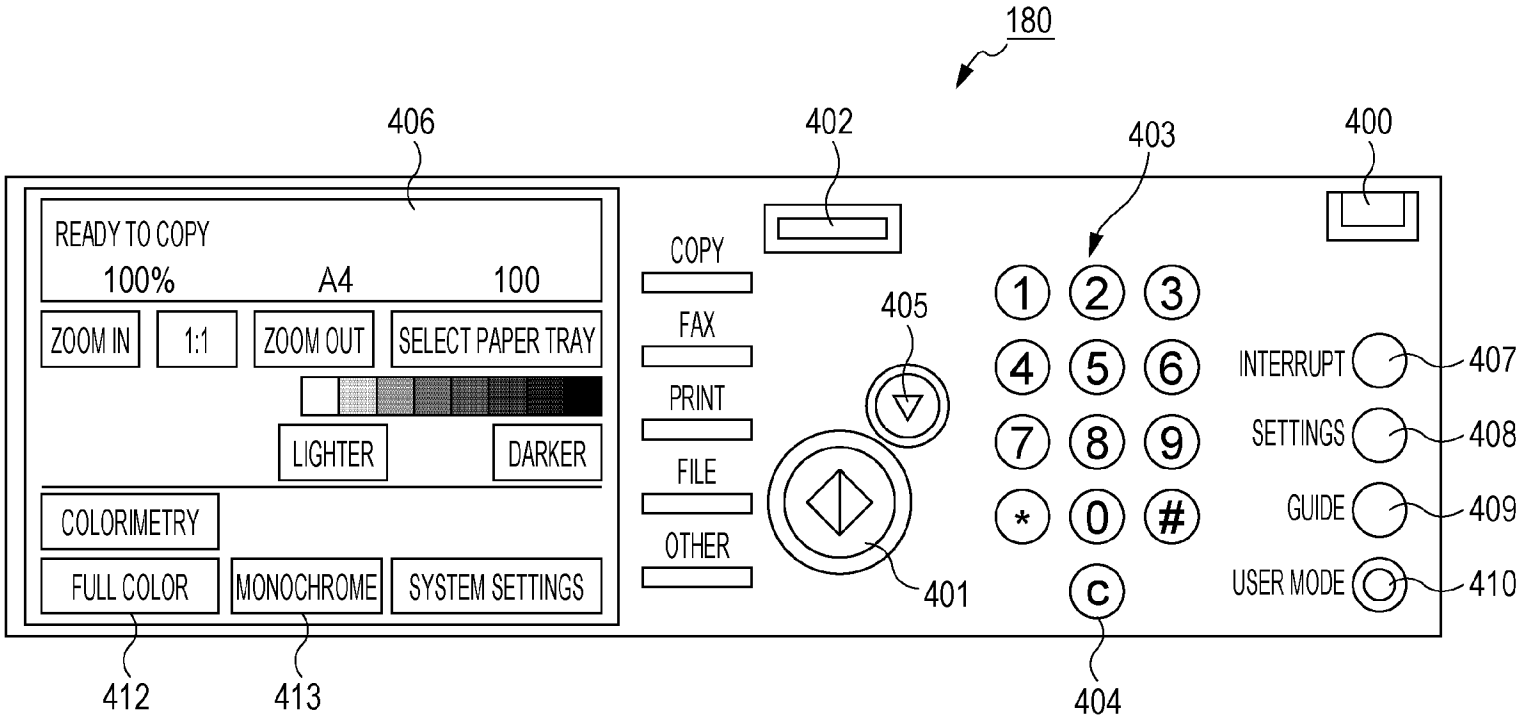
FIG. 6 illustrates an operating unit.

FIG. 6 illustrates the operating unit 180 usable for inputting an operation to the image forming apparatus 100. The operating unit 180 includes a soft switch 400 usable for turning on/off a power source of the image forming apparatus 100, a copy start key 401 usable for instructing a copy start, and a reset key 402 usable for returning to a standard mode. The standard mode is set in "full-color/single side" here, for example.

The operating unit 180 further includes a key pad 403 usable for inputting a numerical value such as a set number of copies, a clear key 404 usable for cancelling the numerical value, and a stop key 405 usable for stopping a continuous copy operation.

A touch panel display 406 is provided on the left side of the operating unit 180 and may display mode settings and a printer status. The operating unit 180 further has, at its right end, an interruption key 407 usable for interrupting an image formation operation for copying, a password key 408 usable for managing the number of copies allocated personally or to a department, and a guidance key 409 to be pressed for using a guidance function.

A user mode key 410 is provided under these keys. The user mode key 410 is usable for entering a user mode in which a user may manage the image forming apparatus 100 and alter settings therein, including designation of a calibration mode, designation of a main-scanning shading mode, and registration of sheet information.

The touch panel display 406 has a full-color image formation mode select key 412, and monochromatic-image formation mode select key 413.

Calibration Mode

Figure 7:
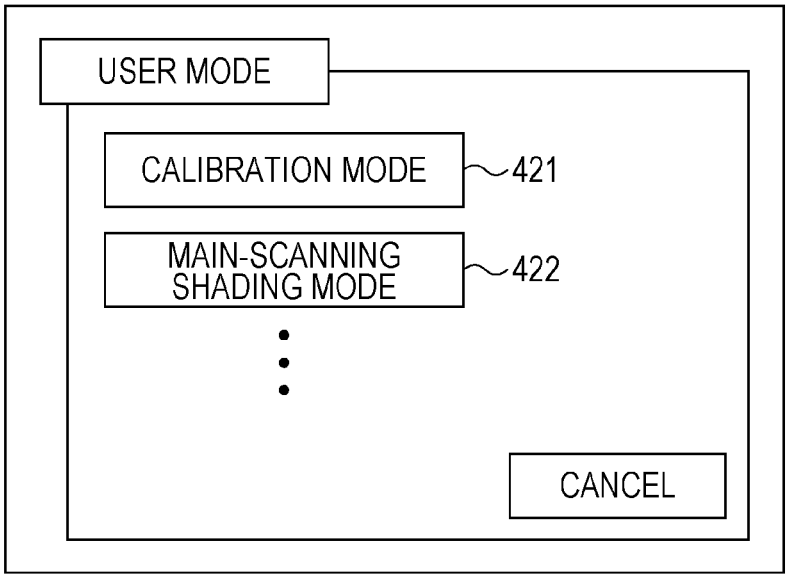
FIG. 7 illustrates a display screen when a user mode key is selected.

Next, a calibration mode according to this embodiment will be described. First, in the operating unit 180 illustrated in FIG. 6, when the user mode key 410 is selected by a user, a screen illustrated in FIG. 7 is displayed on the touch panel display 406.

A calibration mode key 421 is usable for instructing execution of a calibration for improving the color density and color stability of an image. A main-scanning shading mode key 422 is usable for instructing execution of a main-scanning shading correction that corrects an uneven density and/or an uneven color in a main scanning direction (orthogonal to a sheet conveying direction) of an image to be formed on a sheet 110.

It should be noted that the term "calibration" here refers to the aforementioned maximum-density adjustment, tone adjustment, and/or multinary color correction processing. When the calibration mode key 421 is selected, a calibration operation is started. A series of steps of the calibration will be described with reference to flowcharts.

Figure 8:
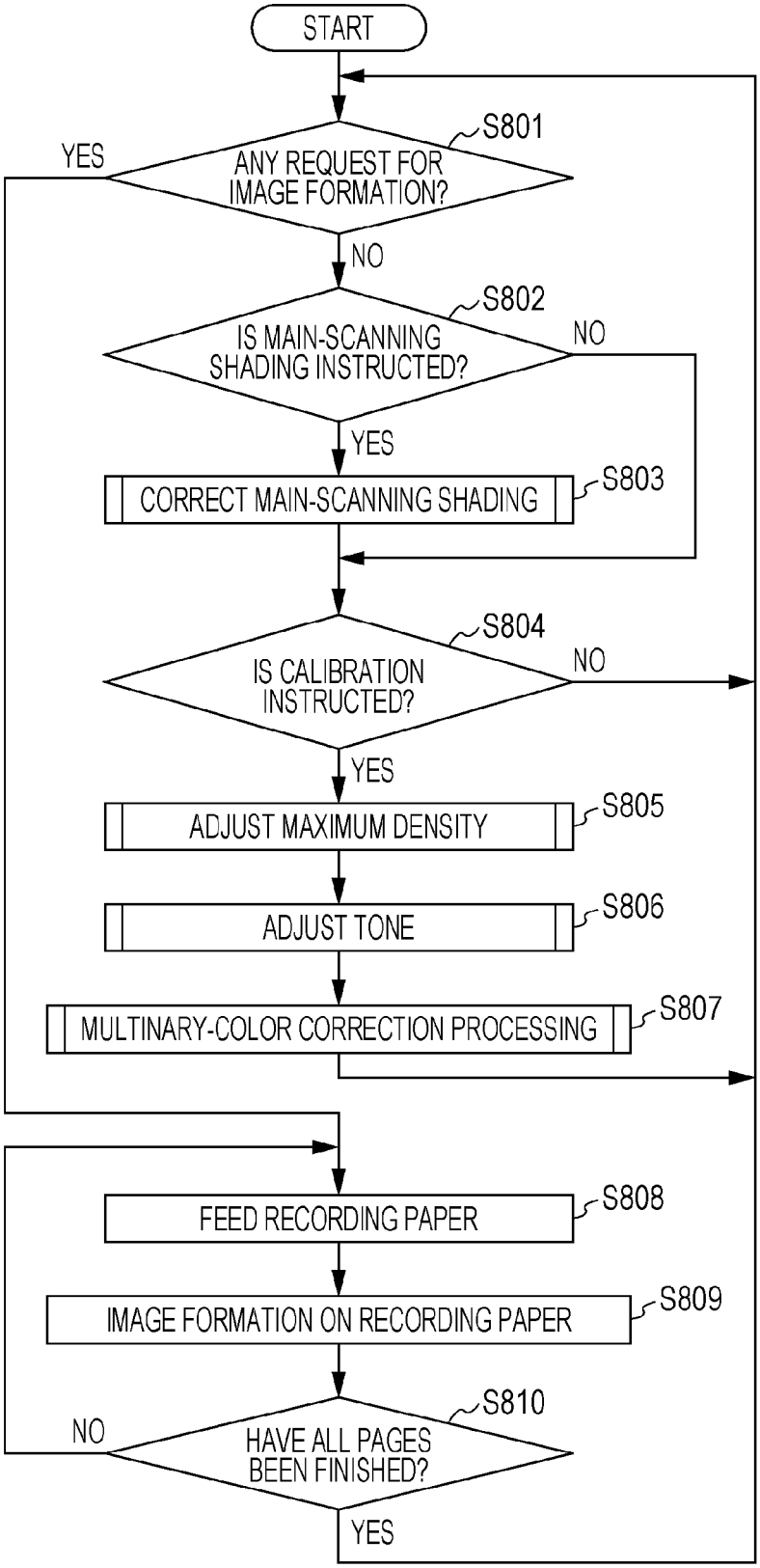
FIG. 8 is a flowchart illustrating an operation of an image forming apparatus.

FIG. 8 is a flowchart illustrating an operation of the image forming apparatus 100. The operation on the flowchart is executed by the printer controller 103. The printer controller 103 first determines whether any request for image formation has been received from the operating unit 180 or not and whether any request for image formation has been received from a host computer through the I/F 308 (S801).

If no request for image formation has been received, the printer controller 103 determines whether main-scanning shading is instructed from the operating unit 180 or not (S802). Main-scanning shading may be instructed by selecting the main-scanning shading mode key 422 as described above. If main-scanning shading is instructed, a main-scanning shading correction (S803) is performed, which will be described below with reference to FIG. 12.

Next, the printer controller 103 determines whether a calibration is instructed by the operating unit 180 or not (S804). A calibration may be instructed in response to selection of the calibration mode key 421 as described above.

Figure 9:
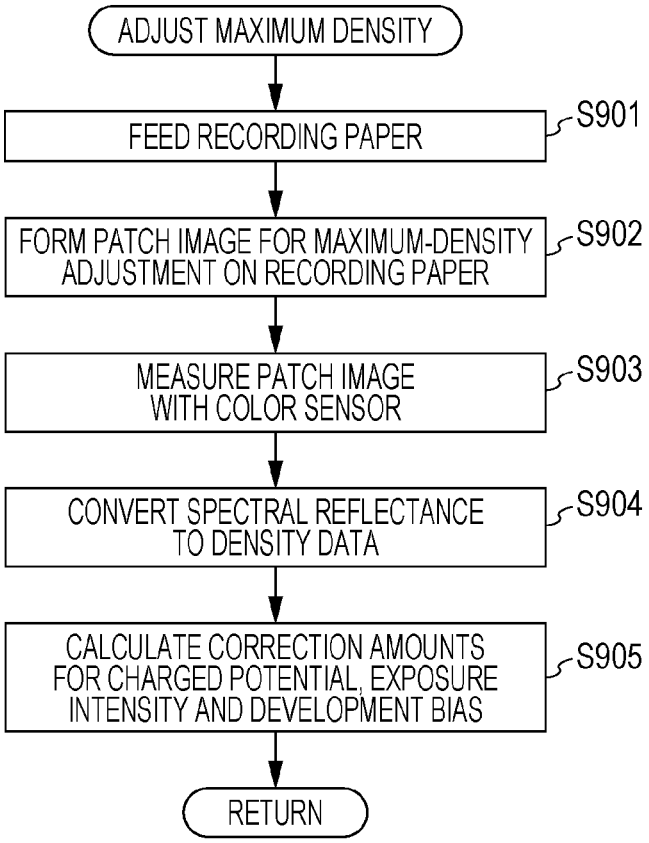
FIG. 9 is a flowchart illustrating an operation for adjusting a maximum density.
Figure 10:
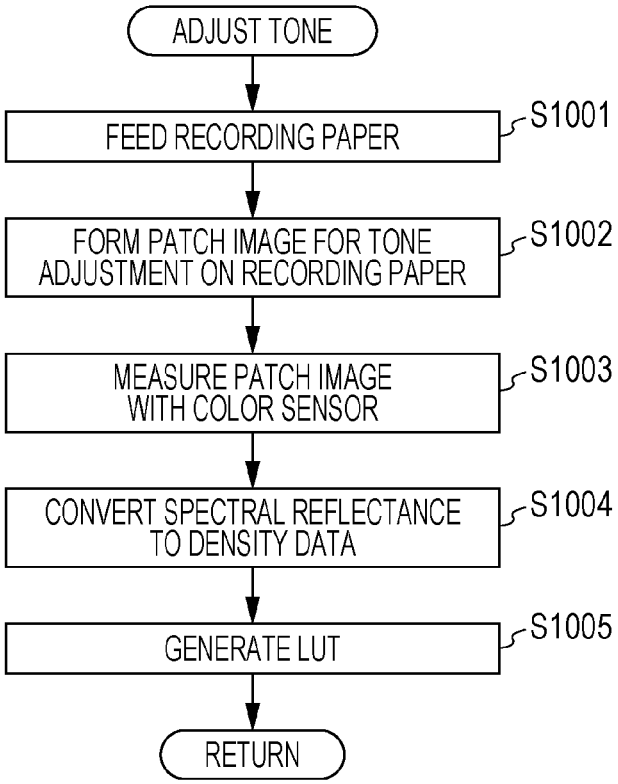
FIG. 10 is a flowchart illustrating an operation for adjusting a tone.
Figure 11:
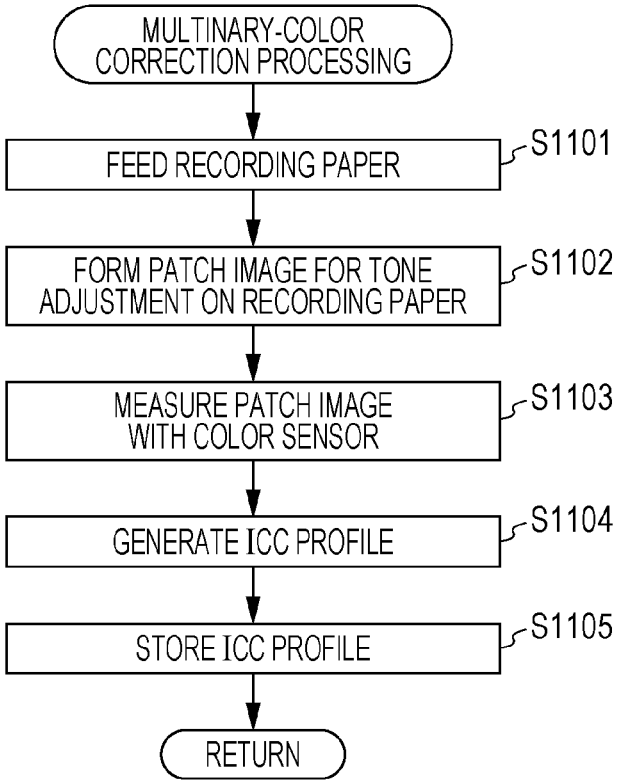
FIG. 11 is a flowchart illustrating an operation of multinary color correction processing.

If a calibration is instructed, a maximum-density adjustment (S805), which will be described below with reference to FIG. 9, is performed, and a tone adjustment (S806), which will be described below with reference to FIG. 10, is performed. After that, a multinary color correction process (S807), which will be described with reference to FIG. 11, is performed. In step S804, if a calibration is not instructed, the processing returns to step S801. A maximum-density adjustment and a tone adjustment are performed before a multinary color correction is performed to perform the multinary color correction process with high accuracy.

In step S801, if it is determined that any request for image formation has been received, the printer controller 103 instructs the engine control unit 102 to feed a sheet 110 from the container 113 (S808). After that, the printer controller 103 instructs the engine control unit 102 to form a toner image on the sheet 110 (S809).

The printer controller 103 then determines whether image formation on all pages has ended or not (S810). If image formation on all pages has ended, the processing returns to step S801. If not, the processing returns to step S808, and image formation is performed on the next page.

FIG. 9 is a flowchart illustrating an operation of a maximum-density adjustment. The processing on the flowchart is executed by the printer controller 103. The image forming apparatus 100 is controlled by the engine control unit 102 in response to an instruction from the printer controller 103.

First, the printer controller 103 instructs the engine control unit 102 to feed a sheet 110 from the container 113 (S901) and to form a patch image for maximum-density adjustment on the sheet 110 (S902). Next, when the sheet 110 reaches the color sensor 200, the printer controller 103 causes the color sensor 200 to measure the patch image (S903).

The printer controller 103 uses the density conversion unit 324 to convert spectral reflectivity data output from the color sensor 200 to CMYK color density data (S904). After that, the printer controller 103 calculates correction amounts for charged potential, exposure intensity, and development bias on basis of the converted color density data (S905). The correction amounts calculated here are stored in the storage unit 350.

FIG. 10 is a flowchart illustrating an operation of a tone adjustment. The processing on the flowchart is executed by the printer controller 103. The image forming apparatus 100 is controlled by the engine control unit 102 in response to an instruction from the printer controller 103.

First, the printer controller 103 instructs the engine control unit 102 to feed a sheet 110 from the container 113 (S1001) and to form a patch image for tone adjustment (16 tones) on the sheet 110 (S1002). Next, when the sheet 110 reaches the color sensor 200, the printer controller 103 causes the color sensor 200 to measure the patch image (S1003).

The printer controller 103 uses the density conversion unit 324 to convert spectral reflectivity data output from the color sensor 200 to CMYK color density data (S1004). After that, the printer controller 103 calculates correction amounts for exposure intensity on basis of the converted color density data to generate an LUT for tone correction (S1005). The LUT generated here is set in the LUT unit 323 for use.

FIG. 11 is a flowchart illustrating an operation of a multinary color correction process. The processing on the flowchart is executed by the printer controller 103. The image forming apparatus 100 is controlled by the engine control unit 102 in response to an instruction from the printer controller 103.

First, the printer controller 103 instructs the engine control unit 102 to feed a sheet 110 from the container 113 (S1101) and to form a patch image for multinary color correction process on the sheet 110 (S1102). Next, when the sheet 110 reaches the color sensor 200, the printer controller 103 causes the color sensor 200 to measure the patch image (S1103).

The printer controller 103 uses the Lab computing unit 303 to calculate color value data (L*a*b*) from spectral reflectivity data output from the color sensor 200. The printer controller 103 generates an ICC profile by the processing above on basis of the color value data (L*a*b*) (S1104) and stores it in the output-ICC-profile storage unit 305 (S1105).

Performing the series of calibrations including a maximum-density adjustment, a tone adjustment, and a multinary color correction process may provide stable color density/tone/hue of an image in the image forming apparatus 100 and allows highly accurate color matching.

Main-Scanning Shading Mode

Figure 12:
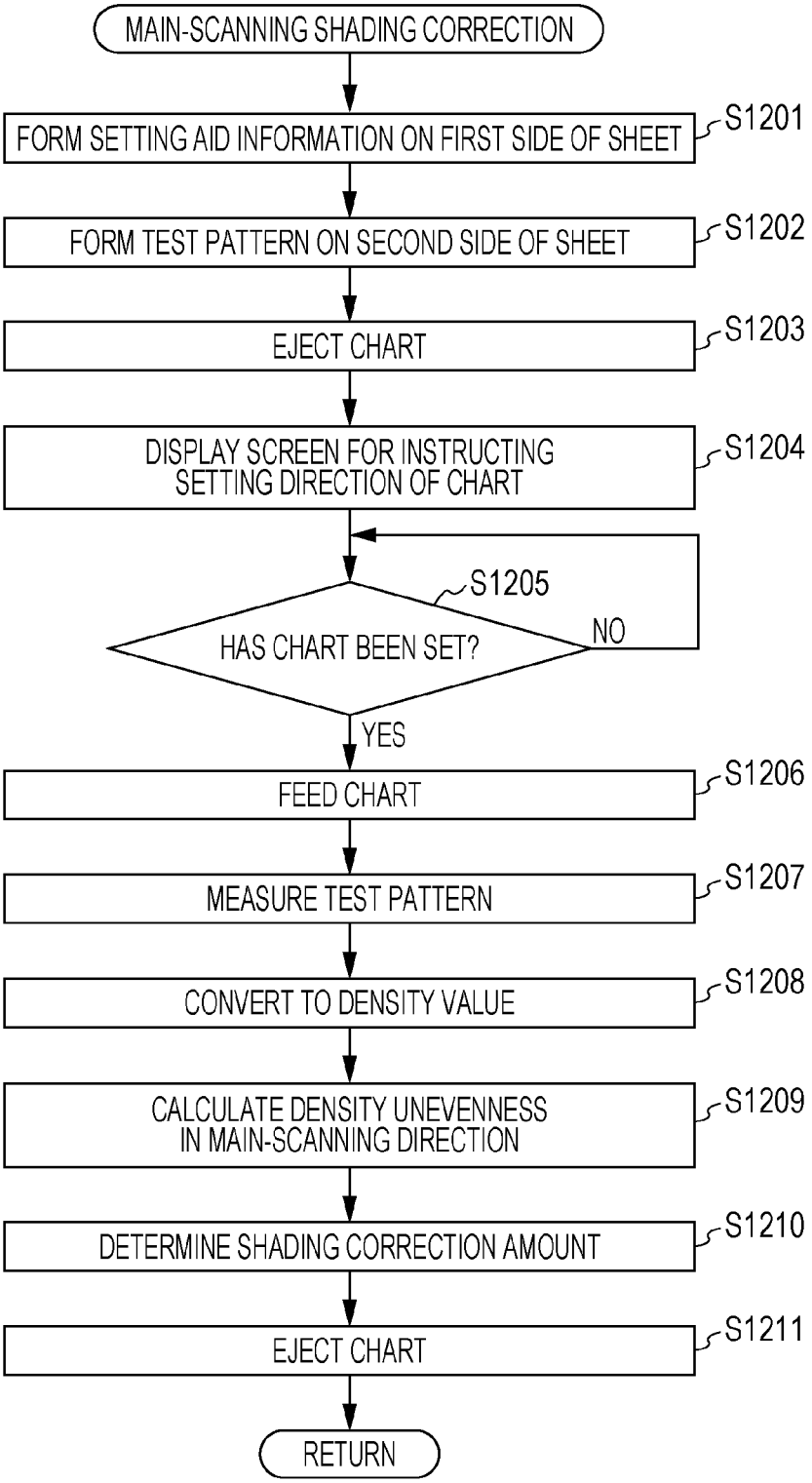
FIG. 12 is a flowchart illustrating an operation of main-scanning shading correction.

FIG. 12 is a flowchart illustrating an operation of a main-scanning shading correction. In this case, an operation of a main scanning shading correction is adjustment processing for reducing unevenness in a main scanning direction. The processing on the flowchart is executed by the printer controller 103. The image forming apparatus 100 is controlled by the engine control unit 102 in response to an instruction from the printer controller 103.

An uneven color in a main scanning direction may be measured from L*a*b* data measured by using the color sensor 200 to correct the uneven color while correction of an uneven density will be described below as an example of unevenness correction.

In response to an instruction to start a main-scanning shading, the printer controller 103 instructs the engine control unit 102 to feed a sheet 110 from the containers 113*a* and 113*b* and form setting aid information on a first side of the sheet 110 (S1201). The sheet feeding position is preset by a user.

Figure 13A:
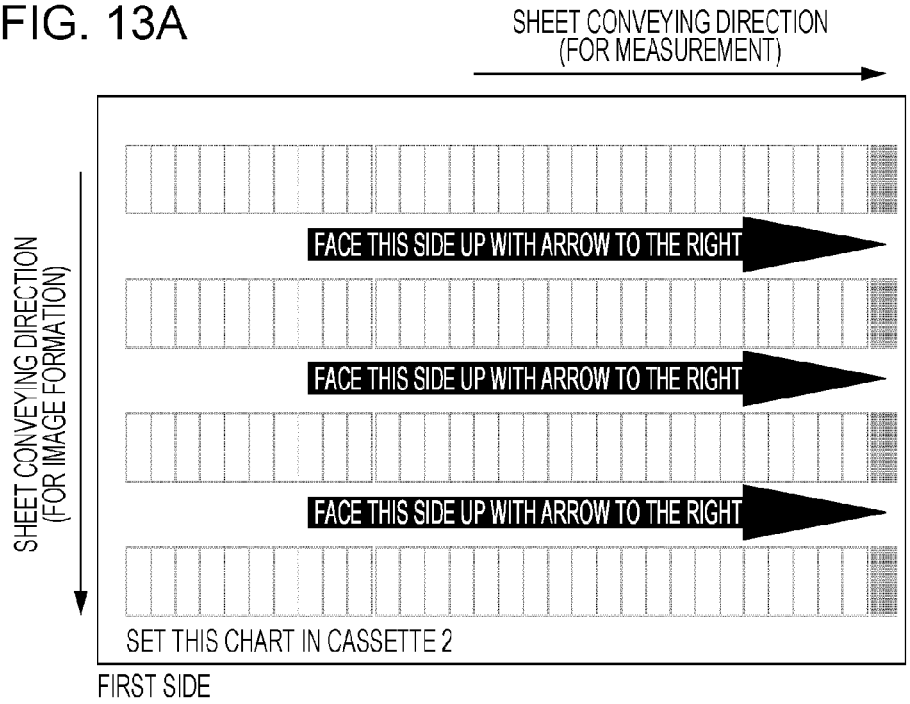
FIG. 13A illustrates setting aid information formed on a sheet.

FIG. 13A illustrates setting aid information formed on a sheet 110. The sheet 110 has a first side having arrows each having a message "FACE THIS SIDE UP WITH ARROW TO THE RIGHT" thereon and a message "SET THIS CHART IN CASSETTE 2". In other words, the setting aid information includes a message that is information for prompting to set a sheet with its first side up in the cassette 2 and arrows that are information describing the direction of the sheet for setting in the cassette 2. Here, the cassette 2 corresponds to the container 113*b*.

The arrow in the setting aid information corresponds to a sheet feeding direction of the sheet 110. Because the containers 113*a* and 113*b* feed a sheet 110 to the right, the sheet 110 has a message that prompts to set the sheet 110 with the arrow to the right.

As illustrated in FIG. 13A, the setting aid information includes information indicating the side to face up, information indicating how the right and left direction to be set, and information describing to which feeder the sheet 110 is to be set. FIG. 13A further illustrates thin lines indicating the positions of measurement images (hereinafter, called a test pattern) to be formed on a second side of the sheet in the next step.

Next, the printer controller 103 instructs the engine control unit 102 to convey the sheet 110 having the setting aid information to the conveying path 138 for double-sided image formation and form the test pattern on the second side of the sheet 110 (S1202).

Figure 13B:
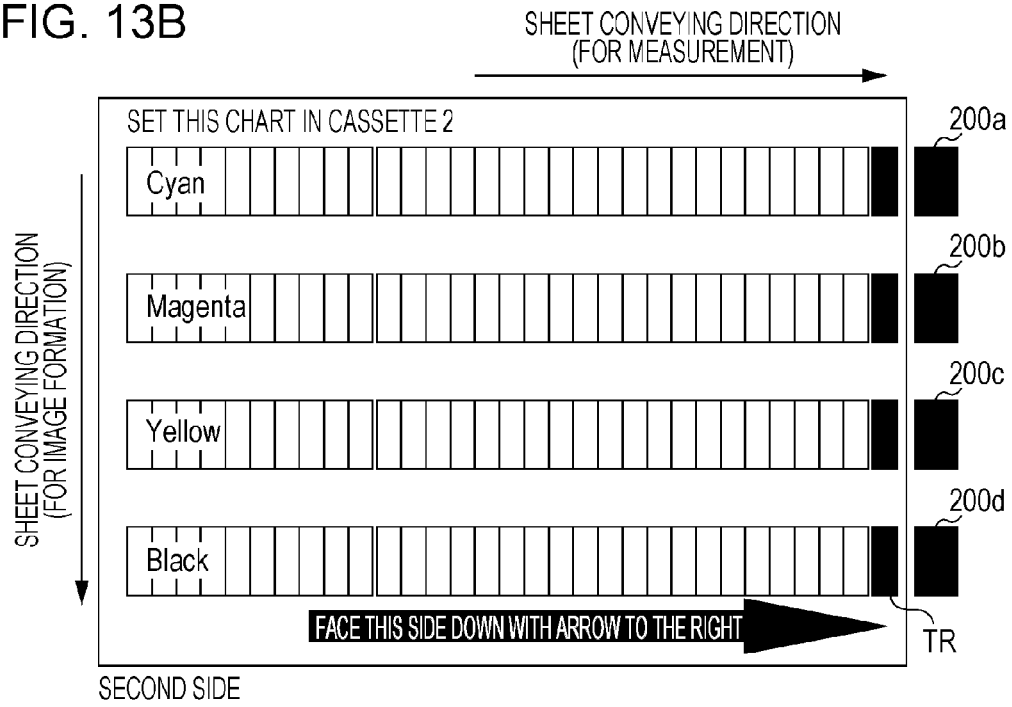
FIG. 13B illustrates a test pattern formed on a sheet.

FIG. 13B illustrates a test pattern formed on a sheet 110. A test pattern according to this embodiment is a band-shaped pattern extending in a main scanning direction and is formed on a sheet 110 for each of CMYK colors. As illustrated in FIG. 13B, the second side of the sheet 110 may also have setting aid information.

The sheet size used in this embodiment is A4 (210 mm×297 mm). The size of the test pattern for each color is 40 mm×270 mm. The test pattern for each color has a 40 mm×10 mm trigger pattern TR (hereinafter, called a trigger) at its end.

Because images are formed on both sides of the chart, the test pattern should be formed without influence of a show-through effect for accurate measurement of the test pattern by the color sensor 200. To prevent the influence, the setting aid information may not be formed at the back of an area having a test pattern to be measured by the color sensor 200.

In order to reduce the number of times of passage of a test pattern through a fixing unit, a test pattern is formed on the second side on which an image is to be formed later instead of the first side on which an image is formed first. If a test pattern is formed on the first side and the setting aid information is formed on the second side, the test pattern is measured after being heated by the fixing unit three times. In other words, a test pattern is formed on the second side to prevent occurrence of a change in density due to excessive fixing such as hot offset.

After step S1202, the printer controller 103 instructs the engine control unit 102 to eject the sheet 110 having the setting aid information and the test patterns (hereinafter called a chart) to outside of the image forming apparatus 100 once (S1203).

Because each of the test patterns is long, band-shaped in the main scanning direction, the chart may be required to rotate 90 degrees and set it in a measurement feeder (such as the container 113*a*) in order to measure all areas of the test patterns with the color sensor 200.

Figure 14:
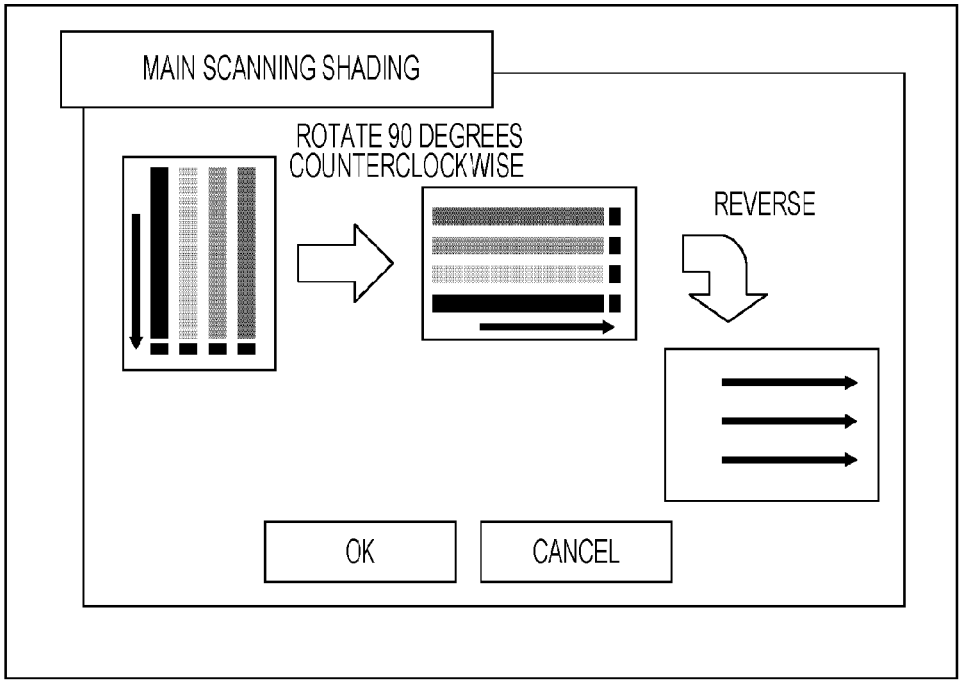
FIG. 14 illustrates a display screen for execution of main-scanning shading.

Once the ejection of the chart completes, the printer controller 103 displays a screen illustrated in FIG. 14 on the touch panel display 406 of the operating unit 180 (S1204). Referring to FIG. 14, it is instructed to rotate counterclockwise 90 degrees, reverse and set the chart ejected with the test-pattern formed side (second side) to set the chart in the container 113*a* or 113*b*.

Next, the printer controller 103 waits for the press of an OK key in FIG. 14, that is, the completion of the setting of the chart (S1205). When the chart setting completes, the printer controller 103 instructs the engine control unit 102 to start feeding the chart (S1206).

When the chart feeding is started, the printer controller 103 measures the CMYK test patterns by using the color sensors 200*a* to 200*d* (S1207). The color sensor 200 identifies the timing for starting test-pattern measurement on basis of the time when the trigger TR is detected. The printer controller 103 uses the density conversion unit 324 to convert the measured values output from the color sensors 200*a* to 200*d* to CMYK color density values (S1208).

Next, the printer controller 103 calculates uneven densities in the main scanning direction on basis of the CMYK color density values acquired by measuring the test patterns (S1209). The details of the method for calculating an uneven density in a main scanning direction will be described below.

The printer controller 103 determines the amount of shading correction on basis of the uneven densities in the main scanning direction calculated by the shading correction-amount determining unit 319 (S1210). The details of the method for determining the amount of shading correction will be described below.

After that, the printer controller 103 ejects the chart (S1211), and the processing on the flowchart ends.

Uneven-Density Calculation Method and Amount of Shading Correction Determination Method Next, the uneven density calculation method in step S1209 in FIG. 12 and the amount of shading correction adjustment method in step S1210 will be described.

Figure 15:
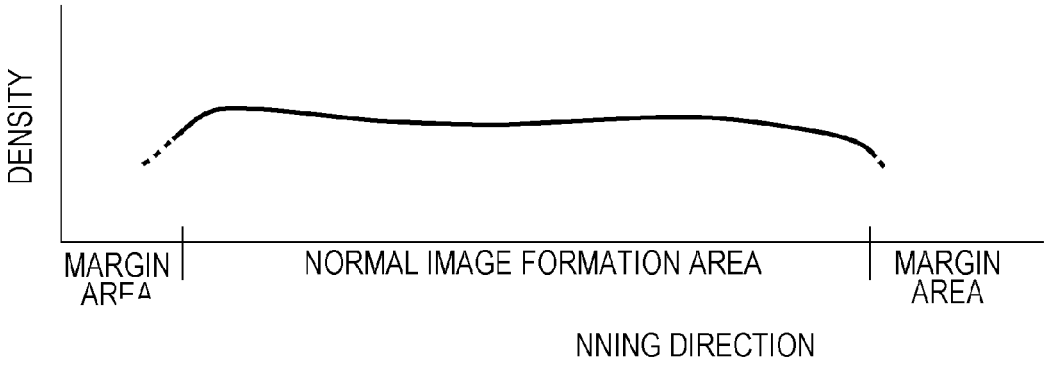
FIG. 15 illustrates a color density distribution in a main scanning direction of a test pattern.

FIG. 15 illustrates a color density distribution, which is acquired in step S1208, of the test pattern in the main scanning direction. In this example, the distribution is based on measurement results of the C (cyan) test pattern. The horizontal axis indicates the position X in the main scanning direction, and the vertical axis indicates optical color density. The test pattern has a color density of 100%.

While C (cyan) will be described here, for example, the same processing may be performed on M (magenta), Y (yellow), and K (black).

As the adjustment method, there have been known a method of changing the degree of pulse width modulation (PWM) of the laser 108 in accordance with the position in a main scanning direction or laser 108 and a method of changing the intensity of radiated light in accordance with the position in a main scanning direction. While the two methods will be described, the adjustment method is not limited to the two methods.

(1) Correction of PWM of Laser 108

When the degree of PWM of the laser 108 is to be corrected, the degree of modulation after the correction may be calculated by the following equation:

$$M'PWM=MPWM\times\beta(x)$$

where

M'PWM: the degree of modulation after a correction

MPWM: the degree of modulation before the correction $\beta(x)$: a correction coefficient in a main scanning direction x: a position in the main scanning direction How the correction coefficient $\beta(x)$ in a main scanning direction is calculated will be described below. The printer controller 103 calculates the ratio of color density $\alpha(x)$ by the following equation:

$$\alpha(x)=D\min/D(x)$$

where the color density value of the lowest color density is Dmin and the color density value at a position X in the main scanning direction is D(x) in a measurement result from the color sensor 200 illustrated in FIG. 16, for example.

Figure 16A:
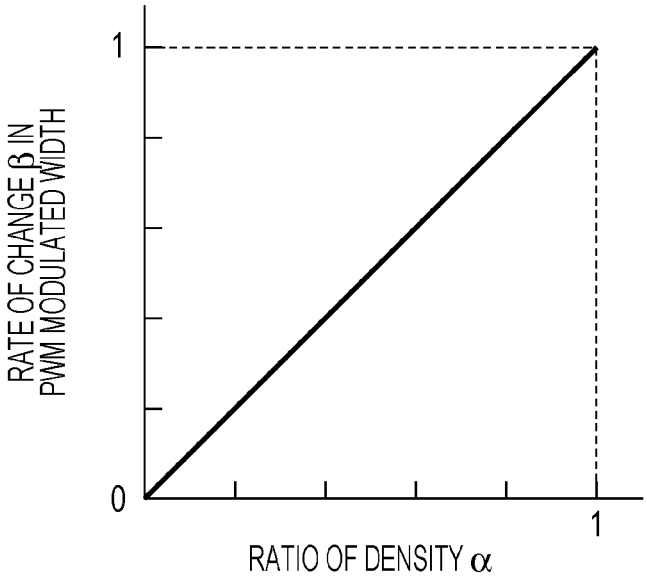
FIG. 16A illustrates a relationship between a ratio of color density $\alpha(x)$ and a correction coefficient $\beta(x)$ in a main scanning direction.

The printer controller 103 converts the ratio of color density $\alpha(x)$ to the correction coefficient $\beta(x)$ in the main scanning direction on basis of a relationship (FIG. 16A) between the ratio of color density $\alpha(x)$ and the correction coefficient $\beta(x)$ in the main scanning direction. The relationship between $\alpha(x)$ and $\beta(x)$ illustrated in FIG. 16A is pre-stored in the storage unit 350 in an equation form, a table form, or the like. The correction coefficient for a part between measurement positions of a test pattern is acquired by an interpolation calculation.

In this way, the printer controller 103 may acquire the degree of modulation M'PWM after a correction, modulate exposure light such that the degree of modulation may be equal to M'PWM, and may correct an uneven density in a main scanning direction.

(2) Correction of Intensity of Light Radiated by Laser 108

The intensity of light radiated by the laser 108 may be corrected, instead of correction of PWM by the laser 108. Correction of an intensity of light irradiated by the laser 108 will be described. In this case, the intensity of radiated light after a correction may be acquired by the following equation:

$$P'=P\times\gamma(x)$$

where

P': the intensity of irradiated light after a correction;

P: the intensity of irradiated light before the correction;

$\gamma(x)$: a correction coefficient in a main scanning direction; and x: a position in the main scanning direction How the correction coefficient $\gamma(x)$ in a main scanning direction is calculated will be described below. The printer controller 103 calculates the ratio of color density $\alpha(x)$ by the following equation:

$$\alpha(x)=D\min/D(x)$$

where the color density value of the lowest color density is Dmin and the color density value at a position X in the main scanning direction is D(x) in the measurement results from the color sensor 200 illustrated in FIG. 15, for example.

Figure 16B:
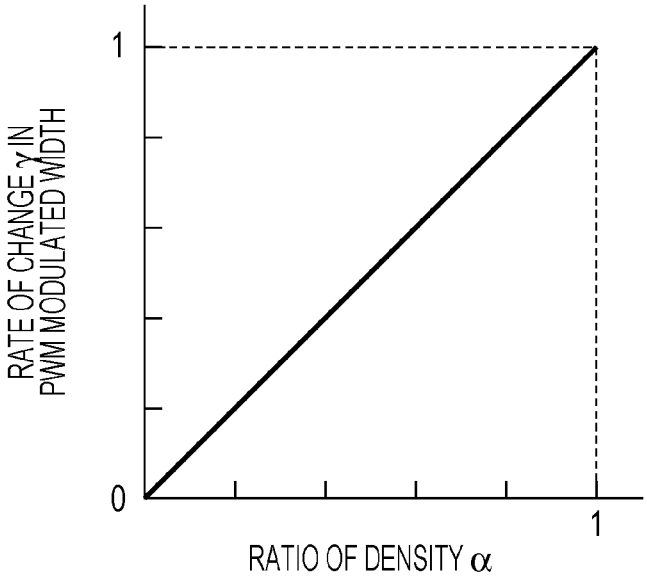
FIG. 16B illustrates a relationship between a ratio of color density $\alpha(x)$ and a correction coefficient $\gamma(x)$ in a main scanning direction.

The printer controller 103 converts the ratio of color density $\alpha(x)$ to the correction coefficient $\gamma(x)$ in the main scanning direction on basis of a relationship (FIG. 16B) between the ratio of color density $\alpha(x)$ and the correction coefficient $\gamma(x)$ in the main scanning direction. The relationship between $\alpha(x)$ and $\gamma(x)$ illustrated in FIG. 16B is pre-stored in the storage unit 350 in an equation form, a table form, or the like. The correction coefficient for a part between measurement positions of a test pattern is acquired by an interpolation calculation.

In this way, the printer controller 103 may acquire the intensity of light P' irradiated by the laser 108 and correct the intensity of irradiated light to P' to correction an uneven density in the main scanning direction.

For maximum-density adjustment, tone adjustment, and multinary color correction processing, a correction result of a main-scanning shading correction may be used to form a patch image with an uneven density corrected.

As described above, this embodiment may indicate the direction for setting a chart in a measurement feeder so that user stress may be reduced when main scanning shading.

Second Embodiment

A configuration in a case where more sheet containers are provided will be described according to a second embodiment. In the print-on-demand (POD) market, a configuration having a plurality of coupled feeding units (hereinafter called decks) is in the mainstream for handling various types of sheet.

Figure 17:
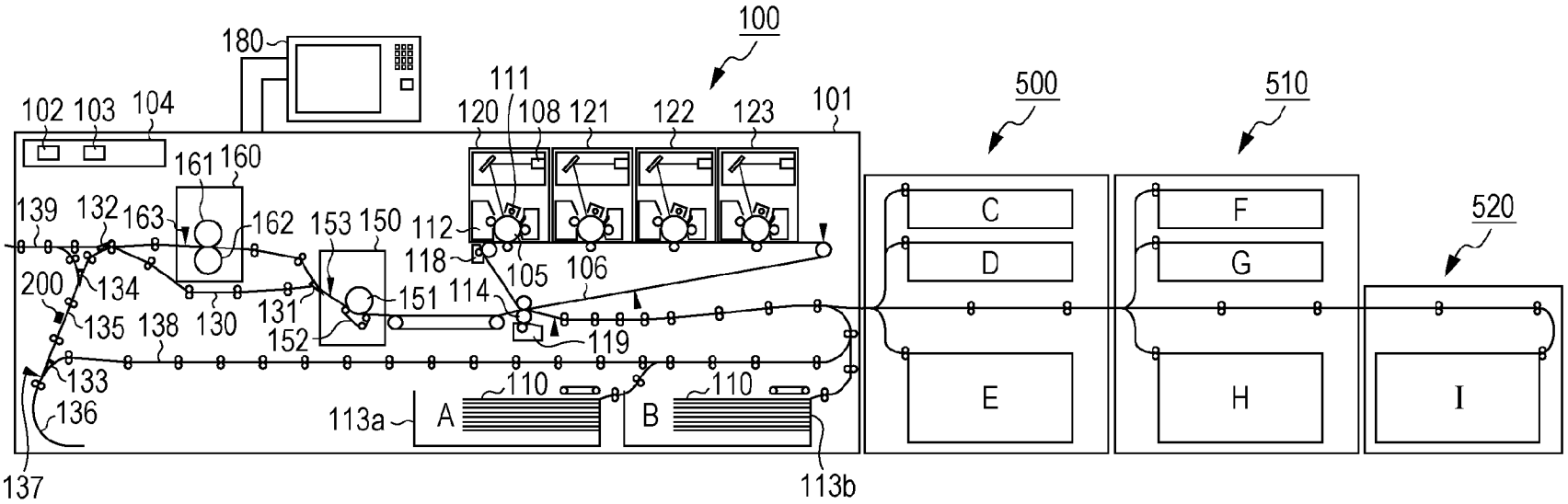
FIG. 17 illustrates decks connected to the image forming apparatus.

FIG. 17 illustrates decks 500, 510, and 520 are connected to the image forming apparatus 100. Each of the decks 500 and 510 has three containers while the deck 520 has one container.

For convenience of description, the containers 113*a* and 113*b* will be called feeders A and B, respectively. Hereinafter, the containers within the deck 500 will be called feeders C, D and E from the top. The container within the deck 520 will be called a feeder I.

The sides of a sheet conveyed from the feeders C to H are reverse to the sides of a sheet conveyed from the feeders A, B and I. A sheet is fed to the left within the feeders C to H while the sheet is fed to the right within the feeders A, B and I. A sheet 110 fed to the right is reversed by a bending conveying path. This may require changing the direction of chart setting in accordance with the feeder for feeding the sheet.

FIG. 18 is a table illustrating information to be shown on a first side and a second side of a chart for each feeder. As on the table, the setting aid information to be printed may be changed in accordance the feeder to be used so that a user may easily recognize the direction of chart setting. The information to be displayed as in FIG. 14 may be changed in accordance with the feeder to be used.

The feeder to be used may be designated by a user through the operating unit 180 or may be selected automatically by the image forming apparatus 100. It may be selected automatically by the image forming apparatus 100 in the following priority levels (1) to (4):

(1) a feeder handling the same sheet size;

(2) a feeder handling the same sheet aspect ratio (A4 or A4R);

(3) a vacant feeder; and (4) a feeder near the operating unit 180.

The priority levels (1) and (2) are set higher in order to select by priority a feeder not requiring changing the position of a regulating member that regulates the sheet position within the feeder. The priority level (3) is set for selecting by priority a feeder not requiring removal of a sheet. The priority level (4) is set for selecting by priority a feeder that is as close as possible to a user.

As described above, this embodiment may reduce user stress involved with main-scanning shading correction even when feeders have different directions of chart setting.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-043229, filed Mar. 5, 2013, which is hereby incorporated by reference herein in its entirety.

What is claimed is:

1. An image forming apparatus comprising:

a feeding unit configured to feed a sheet;

an image forming unit configured to form a measurement image on the sheet fed by the feeding unit;

a measuring unit configured to measure the measurement image formed on the sheet by the image forming unit; and an adjustment unit configured to perform an adjustment operation on basis of a measurement result of the measurement image, wherein the image forming unit forms the measurement image on a first side of the sheet and forms a setting aid image on a second side that is different from the first side;

wherein the setting aid image is formed by avoiding a predetermined area of the second side, and the predetermined area corresponds to a back of the measurement image formed on the first side, and wherein the setting aid image shows information describing a direction of the sheet for setting in the feeding unit and information for prompting to set the sheet with the second side up in the feeding unit.

2. The image forming apparatus according to claim 1, wherein the setting aid image includes an image representing the direction of the sheet for setting in the feeding unit and a message that prompts to set the sheet with the second side up in the feeding unit.

3. The image forming apparatus according to claim 1, in which the feeding unit has a containing unit configured to contain a sheet, the image forming apparatus further comprising a conveying path for conveying the contained sheet such that the image forming unit may form the image on a back side of the contained sheet in the containing unit.

4. The image forming apparatus according to claim 1, wherein the image forming unit has a photosensitive member;

an exposure unit configured to emit a light beam so the light beam scans the photosensitive member in a predetermined direction; and a transferring unit configured to transfer an image formed on the photosensitive member to a sheet; and the adjustment operation is determining a correction condition corresponding to a position in the predetermined direction.

5. The image forming apparatus according to claim 1, wherein the feeding unit has a plurality of containing units; and the setting aid image further shows information for informing a containing unit in which the sheet having the measurement image is to be stored.

6. The image forming apparatus according to claim 1, wherein the image forming unit further forms another setting aid image on the first side of the sheet, and the other setting aid image shows information for prompting to set the sheet with the first side down in the feeding unit.

7. The image forming apparatus according to claim 6, wherein the other setting aid image includes information describing the direction of the sheet for setting in the feeding unit.

8. An image forming apparatus comprising:

a storing unit configured to store a sheet;

an image forming unit configured to form a guidance image on a first side of the sheet being stored in the storing unit, and form a measurement image on a second side of the sheet, wherein the second side of the sheet is different from the first side of the sheet;

a measuring unit configured to measure the measurement image, at a measurement position, formed on the sheet by the image forming unit;

an adjustment unit configured to perform an adjustment operation based on a measurement result of the measurement image; and a feeding unit configured to feed the sheet from the storing unit to the measurement position in a case where the sheet on which the measurement image and the guidance image are formed is stored in the storing unit by a user, wherein the sheet is turned upside down while the feeding unit feeds the sheet from the storing unit to the measurement position, and wherein the guidance image shows information for prompting to set the sheet with the first side up in the storing unit.

9. The image forming apparatus according to claim 8, wherein the guidance image shows the information for prompting to set the sheet with the first side up in the storing unit and information for describing a direction of the sheet for setting the storing unit.

10. The image forming apparatus according to claim 8, wherein the guidance image is formed by avoiding a predetermined area of the first side, and wherein the predetermined area corresponds to a back of the measurement image formed on the second side.

11. The image forming apparatus according to claim 8, wherein the feeding unit feeds the sheet stored in the storing unit along a conveying path, wherein the image forming unit forms the guidance image on the first side of the sheet being fed by the feeding unit, and forms the measurement image on the second side of the sheet, and wherein, in a case where the sheet on which the measurement image and the guidance image are formed is stored in the storing unit by a user, the feeding unit feeds the sheet from the storing unit to the measurement position along the conveying path.

12. The image forming apparatus according to claim 8, wherein the image forming unit comprises:

a photosensitive member;

an exposure unit configured to expose the photosensitive member to form an electrostatic latent image on the photosensitive member; and a developing unit configured to develop the electrostatic latent image, and wherein the adjustment unit adjusts a light intensity of the exposure unit based on the measurement result of the measurement image.

13. The image forming apparatus according to claim 8, wherein the image forming unit comprises:

a photosensitive member;

an exposure unit configured to expose the photosensitive member to form an electrostatic latent image on the photosensitive member; and a developing unit configured to develop the electrostatic latent image, and wherein the adjustment unit adjusts a degree of modulation of light based on the measurement result of the measurement image.

14. The image forming apparatus according to claim 8, further comprising:

a reverse unit configured to reverse two sides of the sheet, wherein the image forming unit forms the guidance image on the first side of the sheet and, after the two sides of the sheet on which the guidance image is formed are reversed, the measurement image is formed on the second side of the sheet.

15. The image forming apparatus according to claim 12, wherein the adjustment unit adjusts the light intensity at a position of the photosensitive member which is exposed by the exposure unit based on the measurement result of the measurement image.

16. The image forming apparatus according to claim 13, wherein the adjustment unit adjusts the degree of modulation of the light at a position of the photosensitive member that is exposed by the exposure unit based on the measurement result of the measurement image.

* * * * *